US006457299B1

(12) United States Patent
Schwenke et al.

(10) Patent No.: US 6,457,299 B1
(45) Date of Patent: Oct. 1, 2002

(54) BEVERAGE-FILLING DEVICE

(75) Inventors: Dieter Schwenke; Jörn Richard Fehland, both of Hamburg (DE)

(73) Assignee: Fehland Engineering GmbH, Hamburg (DE)

( * ) Notice: Subject to any disclaimer, the term of this patent is extended or adjusted under 35 U.S.C. 154(b) by 0 days.

(21) Appl. No.: 09/673,723

(22) PCT Filed: Mar. 12, 1999

(86) PCT No.: PCT/EP99/01651

§ 371 (c)(1),
(2), (4) Date: Oct. 19, 2000

(87) PCT Pub. No.: WO99/54208

PCT Pub. Date: Oct. 28, 1999

(30) Foreign Application Priority Data

Apr. 21, 1998 (DE) ..... 198 17 735

(51) Int. Cl.[7] ..... B65B 55/00

(52) U.S. Cl. ..... 53/510; 53/110; 53/167; 53/432

(58) Field of Search ..... 53/510, 110, 425, 53/426, 432, 167, 79, 86, 97, 266.1, 267, 268, 275

(56) References Cited

U.S. PATENT DOCUMENTS

| | | | | | |
|---|---|---|---|---|---|
| 3,477,192 A | | 11/1969 | Brown et al. | | |
| 3,899,862 A | * | 8/1975 | Muys et al. | ..... | 53/110 |
| 3,911,640 A | * | 10/1975 | Rausing | ..... | 53/110 |
| 3,942,299 A | | 3/1976 | Bory | | |
| 4,707,334 A | * | 11/1987 | Gerhard | ..... | 422/28 |
| 5,024,675 A | | 6/1991 | Stackpool et al. | | |
| 5,114,670 A | * | 5/1992 | Duffey | ..... | 422/24 |
| 5,656,238 A | * | 8/1997 | Spencer et al. | ..... | 422/23 |
| 5,896,727 A | * | 4/1999 | Egli et al. | ..... | 53/426 |

FOREIGN PATENT DOCUMENTS

| | | |
|---|---|---|
| CH | 345260 | 4/1960 |
| DE | 3522996 | 1/1987 |
| DE | 4408301 | 9/1994 |

* cited by examiner

*Primary Examiner*—Rinaldi I. Rada
*Assistant Examiner*—Thanh Truong
(74) *Attorney, Agent, or Firm*—Rankin, Hill, Porter & Clark LLP

(57) ABSTRACT

An apparatus for filling beverage containers under an inert-gas atmosphere. The apparatus includes a stationary filling tool (20) to which the containers (1) are moved and a device for filling the containers with inert gas prior to a beverage-filling procedure. A container engaging element (19) of the filling tool is mounted in a processing chamber (12) that is charged with inert gas and encloses the container (1) in a fill-ready position. The containers are moved through an entry sluice space (11), which can be shut off from the outside and from the processing chamber, by sluice doors (10.1, 10.2).

8 Claims, 1 Drawing Sheet

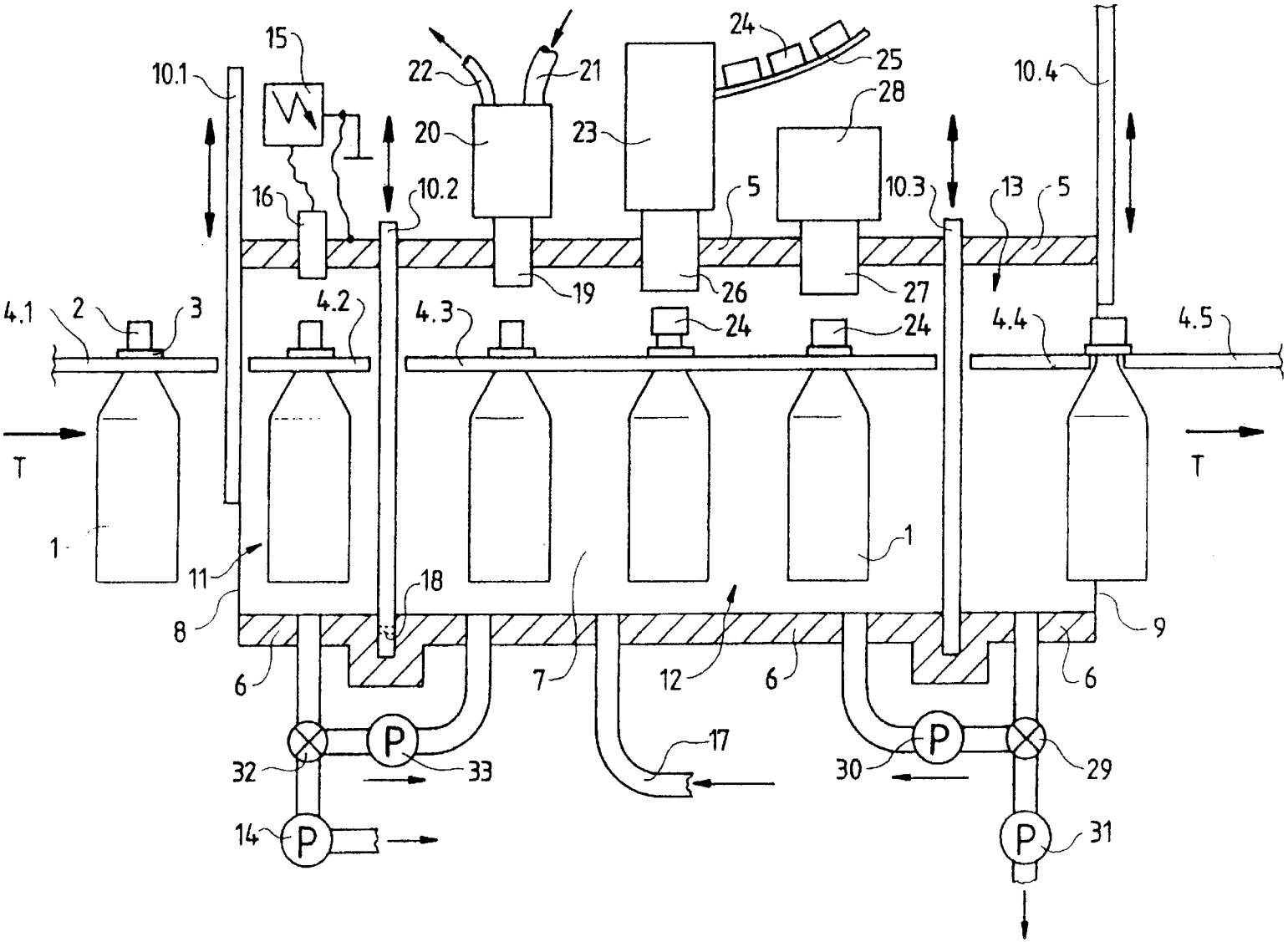
T
4.5
9
10.4
5
13
4.4
6
29
31
P
10.3
27
24
1
25
28
30
24
5
26
24
12
17
23
21
19
7
22
20
10.2
4.3
18
33
15
16
4.2
32
14
10.1
3
11
8
2
4.1
T

BEVERAGE-FILLING DEVICE

BACKGROUND OF THE INVENTION

1. Field of the Invention

The invention relates to an apparatus for filling beverage containers (1) under an inert gas atmosphere, the apparatus having a stationary filling tool (20) to which are led the containers and implements to fill the containers with inert gas prior to the filling procedure.

2. Description of Related Art

Beverages such as beer, lemonades, cocoa etc. are filled into rigid containers such as glass bottles and furthermore into pliant containers such as thin-walled plastic bottles and, before closing, highly pliant metal cans or plastic pouches.

Many beverages are susceptible to oxygen and therefore must be filled into containers in an atmosphere of inert gas, typically $CO_2$, in order to prevent taste alterations and other degradations in quality caused by oxygen entering the container during filling.

As regards highly dimensionally stable containers such as glass bottles or thick-walled plastic bottles, it is known to seal the containers at the site of the filling tool and to fill the containers with inert gas before filling same with the beverage. This procedure entails a complex sealing system and, furthermore, a device implementing the sealing action. Such sealing is very expensive as regards special containers and, in particular, pliant containers. Operational problems may arise. Pliant containers may be over-stretched when being filled with inert gas. In every case they are warped by such procedures and substantial operational difficulties may ensue.

SUMMARY OF THE INVENTION

An objective of the present invention is to create a beverage filling apparatus of the above kind which is of simple design and offers high operational reliability while allowing filling in the presence of only very low oxygen levels.

In the apparatus of the invention, the containers move through the entry sluice or buffer space into the processing chamber loaded with inert gas where they will be filled with inert gas. By pre-conditioning the containers at the sluice or buffer space, the contamination of the inert gas with air, that is the air exchange with the processing chamber, can be minimized. Illustratively the entry sluice space may be flushed with inert gas in order to lower the air contents in the containers before they are moved into the processing chamber. Because the containers within the processing chamber are in an inert-gas atmosphere, the filling tool need not be sealed. Accordingly, the filling tool's design can be substantially simplified. Therefore filling can take place in and "open" state in the processing chamber. Accordingly special bottles and, in particular, pliant containers can be filled in problem-free manner.

Advantages are secured especially with respect to highly pliant containers because these containers are subjected to the same pressure outside and inside within the processing chamber and, therefore, will not be stressed at their walls. The apparatus of the invention need only provide a slight excess pressure in the processing chamber to preclude air entering trough sealing leaks. Non-carbonated beverages may be filled while open within the processing chamber, the chamber also allowing filling beverages with $CO_2$ at higher pressures, in which case a container at the filling tool would have to be sealed during filling. However, the full $CO_2$ pressure may also be set in the processing chamber to fill carbonated beverages. In this case as well the seal between container and filling tool may be eliminated.

In further accordance with the present invention, it is possible in an especially efficacious manner to drag air into the inert gas atmosphere of the processing chamber. Moreover, the container, or at least its cover with fasteners to the container, is sealed inside the processing chamber under inert gas, and the air is prevented from penetrating the top container space after this container has been filled.

The container can be removed from the controlled atmosphere of the processing chamber in a manner which is the reverse of its introduction into the processing chamber. Advantageously, however, the containers are moved in a sluice-conditioned manner into and out of the processing chamber at increased processing speed. The exit buffer or sluice space prevents air-contamination of the processing chamber and pumping back inert gas saves material. Advantageously, moreover, inert gas also may be pumped back from the first sluice space into the processing chamber so that this processing chamber then be externally opened to receive the new container.

In further accordance with the present invention, container sterilization required for micro-organism sensitive beverages such as cocoa, iced tea and the like is integrated in simple manner into the beverage filling apparatus. The first sluice space is especially appropriate for this procedure because it is kept very clean by constantly being evacuated.

In accordance with another feature of the invention, the sterilizing system uses low-pressure plasma sterilization, which is advantageous, and the evacuation system used anyway may be used for attaining the low pressure.

In further accordance with the present invention, an evacuation-generated partial vacuum exists in the first sluice space, before its door to the processing chamber is opened, while for good sealing the inert gas is at slightly reduced pressure in the processing chamber. If the entry sluice-space door is opened abruptly, inert gas enters the entry sluice space as a pulse and might press inward a highly pliant container wall or it also might tip the container. If a vent of small cross-section is opened before the sluice-space door is, then the flooding of the first sluice space takes place gradually without affecting the container.

In further accordance with the present invention, the filling tool need enter the processing chamber only by its portion which engages the container, that is its lower end with the discharge element. The remaining elements remaining elements of the filling tool are advantageously configured outside the processing chamber and, for instance, are accessible for maintenance. As a result the processing chamber can be kept very compact and those elements of the filling tool requiring maintenance are externally accessible. In the same manner other components also present inside the processing chamber, in particular sealing components, may be configured so that their parts not touching the container shall be outside the processing chamber.

In further accordance with the present invention, a series beverage-filling apparatus are provided to fill containers in timed manner in parallel lines. In this manner the filling output is substantially increased.

BRIEF DESCRIPTION OF THE DRAWING

These and further features of the invention will be apparent with reference to the drawing FIGURE, which shows a beverage-filling apparatus of the invention in the form of a strongly schematic vertical section along the direction of container motion.

DETAILED DESCRIPTION OF THE PREFERRED EMBODIMENTS

The shown beverage filling apparatus fills beverages into containers 1 illustratively made of a highly pliant plastic and fitted at their upper neck ends with a thread 2 to seat a cap. The containers also have a neck flange 3 that permits movement of the container on rail segments 4.1–4.5 through the apparatus. The apparatus is also fitted with advance mechanisms (not shown) which, for example, may be slides. The shown rail segments 4.1–4.5 also may be replaced by belts driven in conventional circulatory manner, each being configured left and right from the containers' path of motion and carrying the neck flanges 3 on their inside running segments.

Containers are moved on the first rail segment 4.1 to the shown beverage filling apparatus, which substantially consists of a straight tunnel having an upper wall 5, a lower wall 6 and sidewalls 7. The tunnel can be sealed in the shown strongly schematized embodiment at its entrance aperture 8 and at its exit aperture 9 by sluice-space doors in the form of slides 10.1 and 10.4. The slides 10.1, 10.4 are displaceable, in the direction of the arrow, by drive means (not shown). Two more slides 10.2 and 10.3 are present in corresponding slots of the tunnel between the end slides 10.1 and 10.4 to allow dividing of the tunnel into three compartments. As seen in the direction of container movement in the apparatus, which is indicated by the arrow, the containers move first into an entry sluice space 11, then into a processing chamber 12, and then finally into an exit sluice space 13. As will be discussed more fully hereinafter, the entry and exit sluice spaces 11, 13 essentially serve as inlet and outlet buffers for the containers. The sluice-space doors shown in the form of the two center slides 10.2 and 10.3 are designed, as shown, to preclude communication with of outside air into the processing chamber 12 when the slides 10.1 and 10.4 are lifted to open such doors.

As shown, the containers 1 can be transported in timed manner on the rail segments 4.1–4.5 within the beverage filling apparatus. The rail segments are interrupted at the sluice-space doors to accommodate the slides 10.1–10.4.

The entry sluice space 11 can be loaded with a container when the slide 10.2 is in the closed position and the slide 10.1 is in the open position. After receipt of the container in the entry sluice space 11, the slide 10.1 is moved into the closed position. The presently closed entry sluice space 11 is evacuated by a vacuum pump 14. Optionally, the container may be sterilized in the entry sluice space 11, for instance by filling this space with $H_2O_2$ or, in the manner shown, using a high-frequency plasma generator 15 generating, at the partial vacuum produced by the vacuum pump, a low-pressure plasma by an electrode 16 and the grounded wall parts of the entry sluice space 11.

With the slide 10.1 closed, the slide 10.2 is opened to permit movement of the container into the processing chamber 12. The processing chamber 12 is permanently loaded or charged with an inert gas, such as air-free $CO_2$, through a conduit 17. The processing chamber 12 is preferably charged with the inert gas at a slight excess pressure relative to the ambient atmosphere in order to preclude contaminations at leakage sites. However, to fill carbonated beverages, their filling pressure also may be adjusted inside the processing chamber 12.

A communication conduit of small cross-section, which shall be opened before the slide 10.2 is opened, is present between the processing chamber 12 and the entry sluice space 11. The communication conduit prevents a strong pressure pulse from occurring when the slide 10.2 is abruptly opened. The communication conduit can be configured as a vent 18 at a suitable site on the slide 10.2. As such, the vent 18 is situated outside the entry sluice space and processing chamber when the slide is closed while setting up communication between them when the slide 10.2 is slightly raised while still separating the space and chamber.

The container-engaging element 19 of a filling tool 20 projects in sealed manner from above into the processing chamber 12. The container-engaging element 19, through a line 21, receives the fill beverage and, through a line 22, evacuates gas escaping during filling from the container. The evacuated gas may be fed back into the processing chamber 12. A sealing-cap feed system 23, which receives caps 24 through a chute 25, is situated beyond the filling tool, as seen in the direction of advance T. A container engaging element 26 of the feed system 23 enters the processing chamber 12 in a sealed manner. As shown in the drawing FIGURE, the feed system 23 deposits a sealing cap 24 on each container. Thereupon, the containers arrive at a screwing-tight device 28 which, by its container engaging element 27, projects in sealed manner into the processing chamber 12. The screwing-tight device tightly screws, as shown, a cap 24 onto the thread 2 of the container 1. Naturally, it is contemplated that other kinds of seals than the caps 24 screwed onto threads 2 may be also be used, for instance crown corks, sealed disks or the like. After the next slide 10.3 is opened, the containers arrive inside the exit sluice space 13 from where, after the slide 10.3 has closed and the slide 10.4 has opened, the containers move on the rail segment 4.5 into the ambient.

When a container is being sluice-conditioned in the exit sluice space 13, this space first is opened at the side of the processing chamber 12 and is, therefore, filled with inert gas. Then the exit sluice space is opened outwardly toward the air. In order to minimize the loss of inert gas so incurred, the exit sluice space 13 communicates through a valve 29 and a pump 30 and pertinent conduits with the processing chamber 12. Before the exit sluice space 13 is opened to the outside, any inert gas in it can be pumped back into the processing chamber 12. If the exit sluice space 13 was outwardly open and next is to be opened relative to the processing chamber, the air in the exit sluice space 13 can be evacuated via the appropriately-switched valve 29 and a pump 31.

Once a valve 32 has been switched and before the entry sluice space 11 has been opened to the outside, the inert gas again can be pumped back into the processing chamber 12 by a pump 33.

The sectional FIGURE in each of the processing positions shows one container and one processing device, i.e. one filling tool 20. The shown processing filling system may be configured as a linear array in which each of the processing sites is followed in a direction perpendicular to the plane of the drawing by several consecutive processing sites. For instance with respect to the position of the shown filling tool 20, there are several consecutive filling tools along a line perpendicular to the plane of the drawing. Also, sealing-cap feed systems 23 and screwing-tight devices 28 are severally arrayed along a line perpendicular to the plane of the drawing. The spaces 11 and 13 and the chamber 12 as well as the slides 10.1, 10.2, 10.3 and 10.4 assume corresponding widths in the direction perpendicular to the plane of the drawing. The containers are moved in parallel lines perpendicular to the plane of the drawing in timed manner in the direction of the arrow T. The single-track apparatus shown in the FIGURE also may be expanded to several mutually parallel tracks to commensurately increase the output.

The illustrative embodiment shows containers in the form of pliant plastic bottles with flanged necks. When slightly modifying the conveying means, other containers as well may be processed with the shown beverage filling apparatus, for instance glass bottles, pliant metal cans or pouches on a conveyor means, and which, similar to the bottles 1, are moved suspended by their neck apertures or standing in cardboard.

The required sluice doors are shown as mere slides 10.1, 10.2, 10.3 and 10.4 to close off on both sides the entry sluice space 11 and the exit sluice space 13. However other door designs may be used, for instance rotary slides which with appropriate configuration of their insides may constitute the particular sluice space.

What is claimed is:

1. A beverage-filling apparatus that is adapted to fill containers under an inert gas atmosphere, said apparatus comprising:

a stationary filling tool to which the containers are led, said filling tool including means for filling the containers with inert gas prior to a filling procedure, wherein a container engaging element of the filling tool is mounted in a processing chamber loaded with inert gas and enclosing the container in its filling-ready position, the containers being fed into the processing chamber through an entry sluice space, said entry sluice space being fitted with sluice-space doors to selectively shut off said entry sluice space from an outside area and from the processing chamber; and an exit sluice space to which containers are removed to from the processing chamber, said exit sluice space being fitted with exit sluice space doors to shut off said exit sluice space relative to the outside and to the processing chamber, and wherein during an exit sluice stage, inert gas is pumped back into the processing chamber.

2. The apparatus as defined in claim 1, wherein the entry sluice space is adapted to be evacuated of air prior to introduction of said inert gas therein.

3. The apparatus as defined in claim 1, wherein systems and devices for feeding and sealing container caps on the containers are mounted, by means of their respective container engaging elements, inside the processing chamber beyond the filling tool relative to a direction of motion of the containers.

4. The apparatus as defined in claim 1, wherein the entry sluice space is fitted with means for sterilizing the containers.

5. The apparatus as defined in claim 4, wherein the sterilizing means provides low-pressure plasma sterilization.

6. The apparatus as defined in claim 1, wherein a vent passage of small cross-section extends between the entry sluice space and the processing chamber, said vent passage being adapted to open before the sluice door connecting said processing chamber and said sluice and said space is opened.

7. The apparatus as defined in claim 1, wherein the container engaging element of the filling tool projects into the processing chamber and other components of the filling tool are outside said chamber.

8. The apparatus as defined in claim 1, wherein several filling tools are mounted consecutively in a line transverse to a direction of motion of the containers, the processing chamber and the entry sluice space being configured parallel to the direction of motion.

* * * * *

UNITED STATES PATENT AND TRADEMARK OFFICE

CERTIFICATE OF CORRECTION

PATENT NO. : 6,457,299 B1
DATED : October 1, 2002
INVENTOR(S) : Schwenke et al.

It is certified that error appears in the above-identified patent and that said Letters Patent is hereby corrected as shown below:

Title page, Item [54] and Column 1, line 1,
Delete "DEVICE" and insert -- APPARATUS --.
Item [75], Inventors:, after "Dieter Schwenke" insert -- Schenefeld (DE) --; and delete "both of".

Column 6,
Line 24, after "sluice" delete "and said".

Signed and Sealed this

Eleventh Day of February, 2003

JAMES E. ROGAN
*Director of the United States Patent and Trademark Office*